United States Patent [19]

Nakamura et al.

[11] Patent Number: 4,658,092

[45] Date of Patent: Apr. 14, 1987

[54] EXPLOSION-PREVENTING SUSPENSION INSULATOR

[75] Inventors: Itsushi Nakamura, Nagoya; Shigeo Mori, Kuwana; Hiroshi Nozaki, Nagoya, all of Japan

[73] Assignee: NGK Insulators., Ltd., Japan

[21] Appl. No.: 840,086

[22] Filed: Mar. 17, 1986

[30] Foreign Application Priority Data

May 23, 1985 [JP] Japan ..... 60-111157

[51] Int. Cl.[4] ..... H01B 17/08

[52] U.S. Cl. ..... 174/182; 174/189; 174/196

[58] Field of Search ..... 174/182, 186, 188, 189, 174/194, 196

[56] References Cited

U.S. PATENT DOCUMENTS 2,146,344 2/1939 Meisse ..... 174/196 X
4,559,414 12/1985 Kito et al. ..... 174/182 X

FOREIGN PATENT DOCUMENTS 45-3589 2/1970 Japan ..... 174/182

*Primary Examiner*—Laramie E. Askin
*Attorney, Agent, or Firm*—Parkhurst & Oliff

[57] ABSTRACT

An explosion-preventing suspension insulator includes an insulator body and a metal cap and a metal pin both being bonded to the insulator body by means of cement. A synthetic resin based electrical insulating film having a Young's modulus of elasticity of from 20,000 to 80,000 kgf/cm$^2$ is provided in a specific thickness on the inner surface of the metal cap and the outer surface of the metal pin at a portion where the metal pin is buried into the cement. The preferred thickness of each electrical insulating film is from 600 to 1,500 μm.

2 Claims, 5 Drawing Figures

EXPLOSION-PREVENTING SUSPENSION INSULATOR

BACKGROUND OF THE INVENTION

1. Field of the Invention

The present invention relates to an explosion-preventing suspension insulator which can prevent explosive breakage of an insulator body due to flashover inside the cap. The insulator has substantially the same mechanical strength as that of ordinary suspension insulators.

2. Related Art Statement

When an ordinary suspension insulator is damaged due to a mechanical external force such as that which occurs from a bullet or an electrical external force such as from lightning attack, and a crack extends to a head portion of the insulator body, the insulator will be able to withstand a mechanical working load. However, if an abnormal voltage is applied in this state, it may be that an internal flashover takes place along the surface of the crack inside the cap, and the head portion of the insulator body will break due to an explosively increased internal pressure caused by the internal flashover, which may cause a serious accident in that the insulator string will break. As disclosed in Japanese Patent Publication No. 3,589/70, NGK Insulators, Ltd. have invented a suspension insulator in which the internal flashover is prevented, even upon receiving an abnormal voltage, by forming an insulating layer on the internal surface of a metal cap and the outer surface of a metal pin. However, such an explosion-preventing type suspension insulator is unsatisfactory in reliability because the internal flashover-preventing rate is about 85%. Further, since this suspension insulator has a defect that the mechanical performance cannot be stably maintained, it has not been widely practically used.

SUMMARY OF THE INVENTION

The present invention has as an object the provision of an explosion-preventing suspension insulator which as a matter of course can assuredly prevent the internal flashover and which has substantially the same tensile strength as that of ordinary suspension insulators, thus solving the problems possessed by such conventional suspension insulators.

In general, in order to enhance the electrical insulating performance, it is necessary that pinholes are reduced and the insulating strength is increased. For this purpose, it is desirable that the thickness of the insulating layer be made thicker. However, if the thickness is made too thick, there occurs a problem that the tensile strength as the fundamentally indispensable performance of the suspension insulator is lowered.

Upon having repeatedly reviewed the above points, the present inventors have found that the Young's modulus of the insulating layer has an important meaning with respect to the buffering action upon the tensile load. The present invention has been accomplished on the basis of the above finding.

According to the present invention, there is a provision of an explosion-preventing suspension insulator comprising an insulator body, a metal cap and a metal pin both being bonded to the insulator body by means of cement, wherein a synthetic resin based electrical insulating film having a Young's modulus of elasticity of from 20,000 to 80,000 kgf/cm$^2$ is provided in a thickness of from 300 to 1,500 μm on either one or both of the inner surface of the metal cap and the outer surface of the metal pin at a portion where the metal pin is buried in the cement. In the preferred arrangement, electrical insulating films are provided on both the inner surface of the metal cap and on the outer surface of the metal pin at a portion of the metal pin where it is buried in the cement, and the thickness of each electrical insulating film is from 600 to 1,500 μm.

These and other objects, features and advantages of the present invention will be well appreciated upon reading of the following description of the invention when taken in connection with the attached drawings, with the understanding that some modifications, variations and changes of the same could be easily made by the skilled in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein.

DETAILED DESCRIPTION OF THE INVENTION

Now, the present invention will be explained more in detail with reference to an embodiment shown in the attached drawings.

Figure 1:
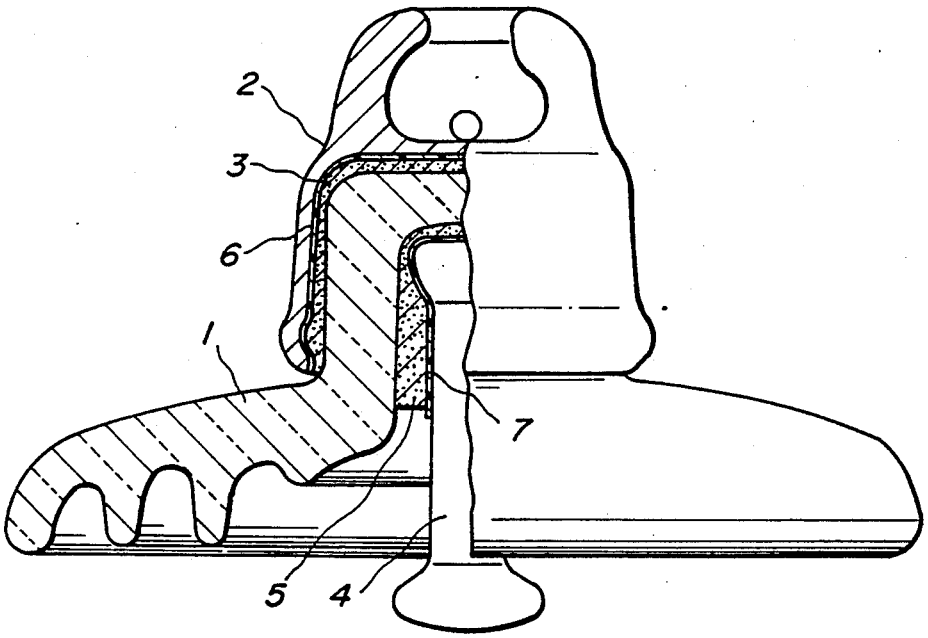
FIG. 1 is a partially cut-away front view of a suspension insulator according to the present invention.

In FIG. 1, reference numerals 1, 2 and 4 denote an insulator body made of a porcelain, a metal cap secured to a head portion of the insulator body by means of cement 3, and a metal pin fixed at the central portion of a recess on the underside of the insulator body 1 by means of cement 5, respectively.

In ordinary conventional suspension insulators, a soft vitreous paint is coated onto the inner surface of the metal cap 2 and the outer surface of the metal pin 4 at portions brought into contact with the cement 3, 5 in a thickness of from 10 to 20 μm, respectively. According to the conventional explosion-preventing insulators mentioned above, an insulating layer made of epoxy resin, urethane resin or the like is formed thereon.

Figure 2:
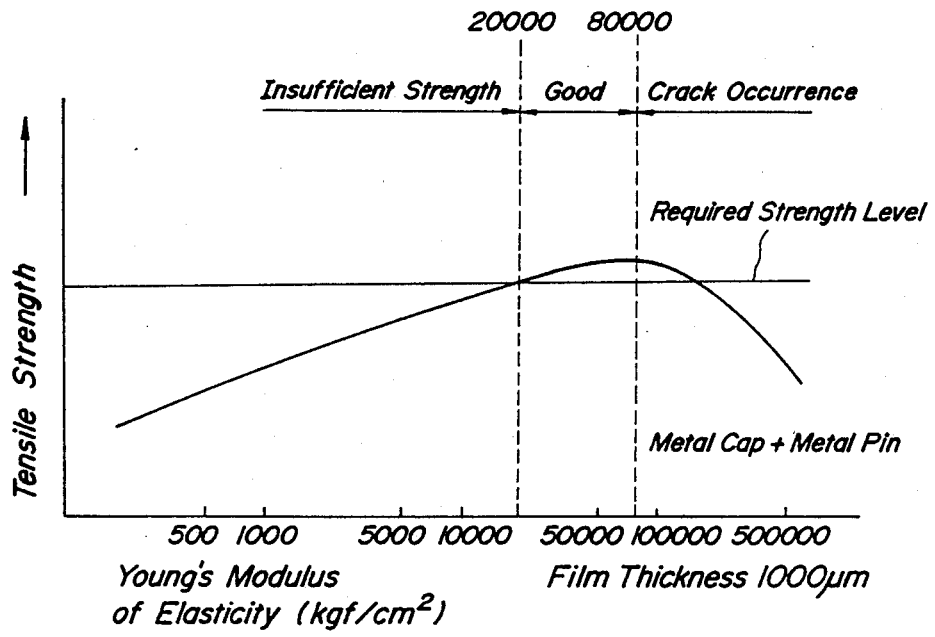
FIG. 2 is a graph showing the relationship between Young's modulus of elasticity of an electrical insulating film and the tensile strength of the suspension insulator.
Figure 3:
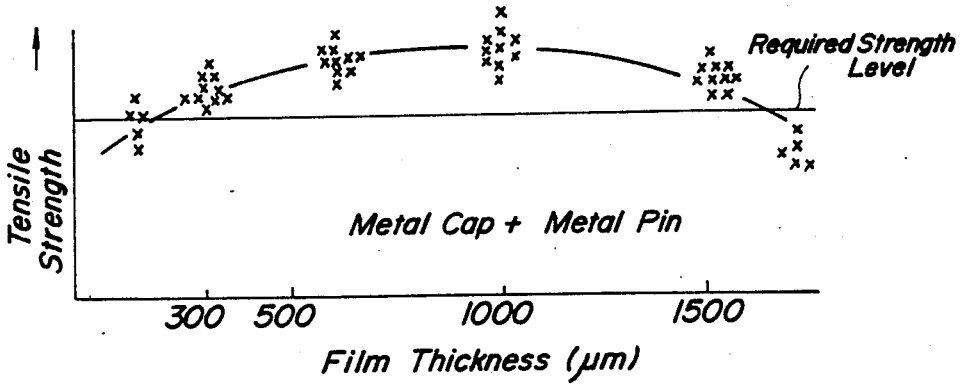
FIGS. 3 to 5 are graphs showing the relationships between the thickness of the electrically insulating film and the tensile strength of the suspension insulator.
Figure 4:
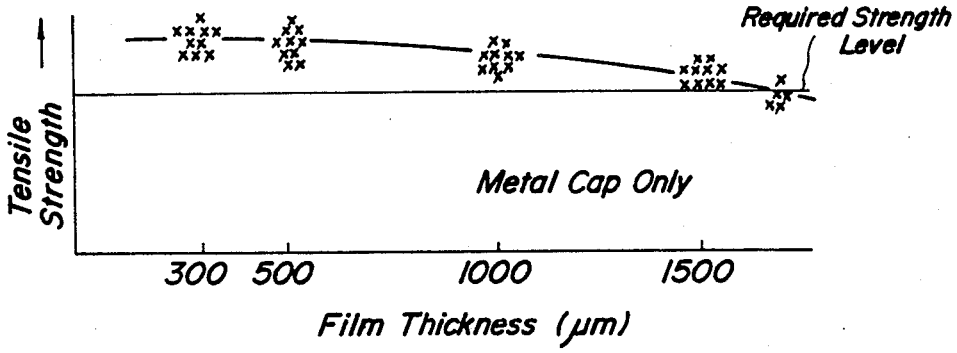
Figure 5:
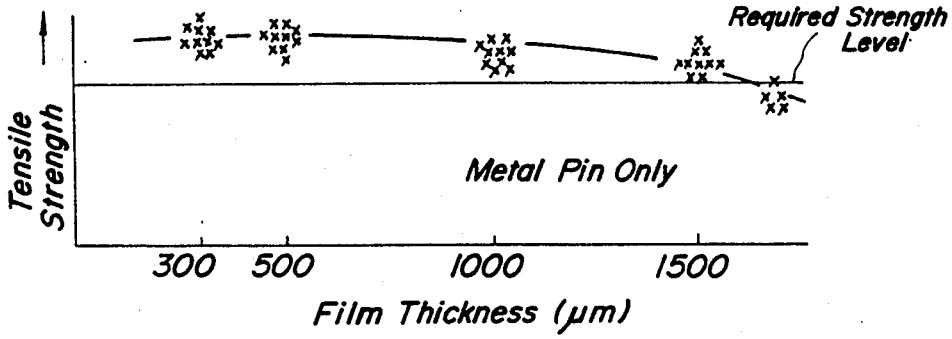

On the other hand, according to the present invention, electrical insulating films 6 and 7 basically made of a synthetic resin such as an epoxy resin, polyester resin, acrylic resin or the like having a Young's modulus of elasticity of 20,000 to 80,000 kgf/cm$^2$, are formed at the above portions in a thickness of from 300 to 1,500 μm. The reason why the Young's modulus of the electrical insulating films 6 and 7 is restricted to 20,000 to 80,000 kgf/cm$^2$ is that, as shown in FIG. 2, the film is too soft in the case of less than 20,000 kgf/cm$^2$ to lower the tensile strength of the whole suspension insulator, while if the Young's modulus of elasticity is over 80,000 kgf/cm$^2$, cracks will be produced to lower the electrical insulating property. The reason why the thickness of the film is restricted to from 300 to 1,500 μm is that a complete coat film cannot be formed in the case of less than 300 μm to pose a problem upon the electrical insulating performance and a mitigating ability against tensile load when the electrical insulating films 6 and 7 are applied both to the metal cap 2 and the metal pin 4. While if the thickness exceeds 1,500 μm, the electrical insulating films 6 and 7 are squeezed by the tensile load to make the displacement larger and accordingly lower the tensile strength, too. This relation between the film thickness and the tensile strength of the suspension insulator is shown in the graphs of FIGS. 3 to 5. FIG. 3 shows a case in which the electrical insulating films 6 and 7 are formed onto both the metal cap 2 and the metal pin 4. FIG. 4 shows a case in which the electrical insulating film is formed on the metal cap 2 only. FIG. 5 shows a case in which the electrical insulating film is formed on the metal pin 4 only.

According to the thus constituted insulator, even when a crack is produced in the insulator body 1 owing to some external force and an abnormal voltage is applied between the metal cap 2 and the metal pin 4, an internal flashover will not occur along the surface of the crack inside the cap, since the electrical insulating film 6 is formed on the inner surface of the metal cap 2, or the electrical insulating film 7 is formed on the outer surface of the metal pin 4, or both the inner surface of the metal cap 2 and the outer surface of the metal pin 4 are provided with electrical insulating films 6 and 7, respectively. In addition, the Young's modulus of elasticity and the film thickness of the electrical insulating films 6 and 7 are selected such that appropriate hardness and tension resistance can be exhibited and the tensile load may be dispersed and mitigated. Thus, as shown in FIGS. 2 to 5, the same excellent tensile strength as in the ordinary suspension insulators can be obtained.

Although favorable results are attained by providing an electrical insulating film of the type set forth above on only the inner surface of the metal cap or only on the outer surface of the metal pin where it is embedded in the cement, for best results it is preferred to provide electrical insulating films at both these locations. Also, the preferred thickness for each electrical insulating film is from 600 to 1,500 μm.

In the following, results of tests regarding the arc resistance characteristics under a tensile load with respect to the explosion-preventing suspension insulators according to the present invention and conventional ordinary suspension insulators coated with a bituminous paint are shown.

In each sample, a crack was made at a head portion of a 10 inch diameter suspension insulator of a 120 KN grade (M & E Rating: 120 KN). In the suspension insulators according to the present invention, the electrical insulating films 6 and 7 made of an epoxy resin layer having a Young's modulus of elasticity of 50,000 kgf/cm$^2$ both had a thickness of 1,000 μm. As the conventional suspension insulator, products coated with the bituminous paint in a thickness of 20 μm were adopted. An arc resisting test was carried out under an application of a tensile load corresponding to 20% of the rated load for a time of 0.2 second at 11 KA. As a result, all ten samples of the present invention underwent external flashover but did not suffer from the pin being pulled off due to the explosion. Five of ten samples of the conventional products were so exploded due to the internal flashover that the pins were pulled off. Further, arc resisting tests were carried out under an application of a tensile load corresponding to 50% of the assured load. All five samples of the present invention underwent external flashover. On the other hand, all five conventional samples exploded due to the internal flashover to cause the pulling off of the pin.

As is obvious from the above, according to the present invention, the reliability of preventing the explosive breakage of the suspension insulator due to the internal flashover can be enhanced and substantially the same tensile strength as in the ordinary suspension insulators can be attained by forming the electrical insulating film of a specific Young's modulus of elasticity and thickness onto either one of or both of the inner surface of the metal cap of the suspension insulator and the outer surface of the metal pin at a place in which the metal pin is buried in the cement. Thus, the present invention largely contributes to the industry in that the invention eliminates the defects of the conventional explosion-preventing suspension insulator of this type.

What is claimed is:

1. An explosion-preventing suspension insulator comprising:

an insulator body having an inner surface and an outer surface;

a metal cap having an inner surface and an outer surface, said inner surface of the metal cap having a first electrical insulating film thereon, said inner surface of the metal cap, with said first electrical insulating film thereon, being bonded to the outer surface of the insulator body by cement; and a metal pin having an outer surface with a second electrical insulating film thereon, said outer surface of the metal pin, with said second electrical insulating film thereon, being bonded to the inner surface of the insulator body by cement, and said second electrical insulating film being present on said outer surface of the metal pin at least where said metal pin is buried in the cement, wherein said first and second electrical insulating films comprise a synthetic resin based electrical insulating film having a Young's modulus of elasticity of 20,000–80,000 kgf/cm$^2$ and a thickness of 600 to 1,500 μm.

2. An explosion-preventing suspension insulator according to claim 1, wherein said first and second electrical insulating films comprise a material selected from the group consisting of epoxy resins, polyester resins, and acrylic resins.

* * * * *